US011565381B2

(12) United States Patent
Leal et al.

(10) Patent No.: US 11,565,381 B2
(45) Date of Patent: Jan. 31, 2023

(54) MAGNETIC TOOL SYSTEM

(71) Applicants: Alejandro C. Leal, San Antonio, TX (US); DeNicco A. Leal, San Antonio, TX (US)

(72) Inventors: Alejandro C. Leal, San Antonio, TX (US); DeNicco A. Leal, San Antonio, TX (US)

( * ) Notice: Subject to any disclaimer, the term of this patent is extended or adjusted under 35 U.S.C. 154(b) by 26 days.

(21) Appl. No.: 17/065,141

(22) Filed: Oct. 7, 2020

(65) Prior Publication Data

US 2022/0105609 A1 Apr. 7, 2022

(51) Int. Cl.
*B65D 85/28* (2006.01)
*B25B 11/00* (2006.01)
*B25H 3/06* (2006.01)

(52) U.S. Cl.
CPC ..... *B25B 11/002* (2013.01); *B25H 3/06* (2013.01)

(58) Field of Classification Search
CPC ..... B25H 3/06; B25B 11/002; B25B 23/12
USPC ..... 206/234, 349, 350, 372–375, 379, 818; 211/70.6; 81/125, 451, 489
See application file for complete search history.

(56) References Cited

U.S. PATENT DOCUMENTS 2,686,325 A * 8/1954 Silver ..... A46B 5/04 401/7
4,061,225 A 12/1977 Pettitt
4,105,239 A 8/1978 Akczinski
5,405,004 A * 4/1995 Vest ..... B25H 3/06 206/372
5,577,426 A * 11/1996 Eggert ..... B25B 23/12 81/439
5,794,497 A * 8/1998 Anderson ..... B25B 11/002 81/125
5,829,082 A * 11/1998 Moreira ..... B25F 1/02 81/489
6,655,243 B2 12/2003 Anderson et al.
6,668,689 B1 12/2003 Lai
7,039,975 B1 5/2006 Liao
7,510,092 B2 3/2009 Sholem
8,474,615 B2 * 7/2013 Kernodle, Jr. ..... B25H 3/003 206/349
8,505,420 B2 8/2013 Alfaro
10,631,570 B1 4/2020 Morris
2003/0038100 A1 * 2/2003 Liu ..... B25H 3/06 211/90.01
2012/0000325 A1 1/2012 Hsieh
(Continued)

OTHER PUBLICATIONS

Instagram, 710swords, Internet, https://www.instagram.com/p/CDrNF3AhOvA/, Aug. 9, 2020, 1 page, USA.
(Continued)

*Primary Examiner* — Luan K Bui
(74) *Attorney, Agent, or Firm* — Olav M. Underdal; IDP Patent Services

(57) ABSTRACT

A tool system includes a magnetic tool base; mounting handles, each with an inner magnet and a lower magnet; interchangeable tool portions, each detachably attachable to a mounting handle; such that an interchangeable tool portion and a mounting handle form an assembled tool that is held together by the inner magnet, and such the assembled is secured in an upright position on the magnetic tool base by the lower magnet.

25 Claims, 7 Drawing Sheets

(56) References Cited

U.S. PATENT DOCUMENTS

| | | | | |
|---|---|---|---|---|
| 2014/0020848 | A1* | 1/2014 | White | B25G 1/105 81/489 |
| 2016/0074135 | A1 | 3/2016 | Aboalshamat et al. | |
| 2016/0199162 | A1* | 7/2016 | Brilliant | A61C 3/02 132/328 |
| 2019/0240704 | A1 | 8/2019 | Brooks | |

OTHER PUBLICATIONS

Instagram, 710swords, Internet, https://www.instagram.com/p/CDcYyETnf0b/, Aug. 3, 2020, 1 page, USA.
Instagram, Allin_arts, Internet, https://www.instagram.com/p/CDZwpwOnEJj/, Aug. 2, 2020, 2 pages, USA.

* cited by examiner

Magnetic Tool System

Interchangeable Tool Portion

MAGNETIC TOOL SYSTEM

CROSS-REFERENCE TO RELATED APPLICATIONS

N/A

FIELD OF THE INVENTION

The present invention relates generally to the field of handheld tool systems, and more particularly to tool methods and systems for the extraction of cannabis oil concentrate.

BACKGROUND OF THE INVENTION

Consumers will frequently use an oil-based cannabis concentrates in conjunction with a heated surface for cannabis usage.

However, such usage often requires a dabber tool to extract the oil-based cannabis concentrate and place the oil-based cannabis concentrate to the heated surface. While some dabber tools are available, there are generally no available options for a magnetic mount structure and a multitude of interchangeable tool tops for efficient sanitation and organization.

As such, considering the foregoing, it may be appreciated that there continues to be a need for novel and improved devices and methods for dabber devices used in the extraction of the oil-based cannabis concentrates to a secondary surface.

SUMMARY OF THE INVENTION

The foregoing needs are met, to a great extent, by the present invention, wherein in aspects of this invention, enhancements are provided to the existing model of magnetic dabber tool systems.

In an aspect, a tool system can include:

a) a tool base, which includes a substantially flat tool receiving area, wherein the tool base can be made from a magnetic metal;

b) at least one mounting handle, wherein the mounting handle can be configured to be positionable in an upright position on the tool base; and c) at least one interchangeable tool portion, which can be configured to be detachably attachable to the mounting handle;

such that the at least one interchangeable tool portion can be held upright by the mounting handle;

wherein the at least one interchangeable tool portion and the mounting handle form an assembled tool;

whereby the at least one interchangeable tool portion can be removable from the mounting handle for the sanitation and replacement of the at least one interchangeable tool portion.

In a related aspect, the tool base can be configured as a tray, which includes an outer rim and shallow inner flat platform, such that the outer rim and the inner platform can be made of a magnetic metal.

In another related aspect, the tool system can include a plurality of mounting handles, such that a selected interchangeable tool portion in the plurality of interchangeable tool portions can be inserted into a corresponding mounting handle in the plurality of mounting handles, whereby the selected interchangeable tool portion and the corresponding mounting handle form an assembled tool.

In yet another aspect, the mounting handle can include:

a) a lower magnet, positioned on a bottom portion of the mounting handle, such;

such that the mounting handle can stand upright when placed on the magnetic tool base; and b) an inner magnet, such that the inner magnet can be positioned inside a receiving interior of the mounting handle;

such that the inner magnet secures the magnetic interchangeable tool portion in the mounting handle.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
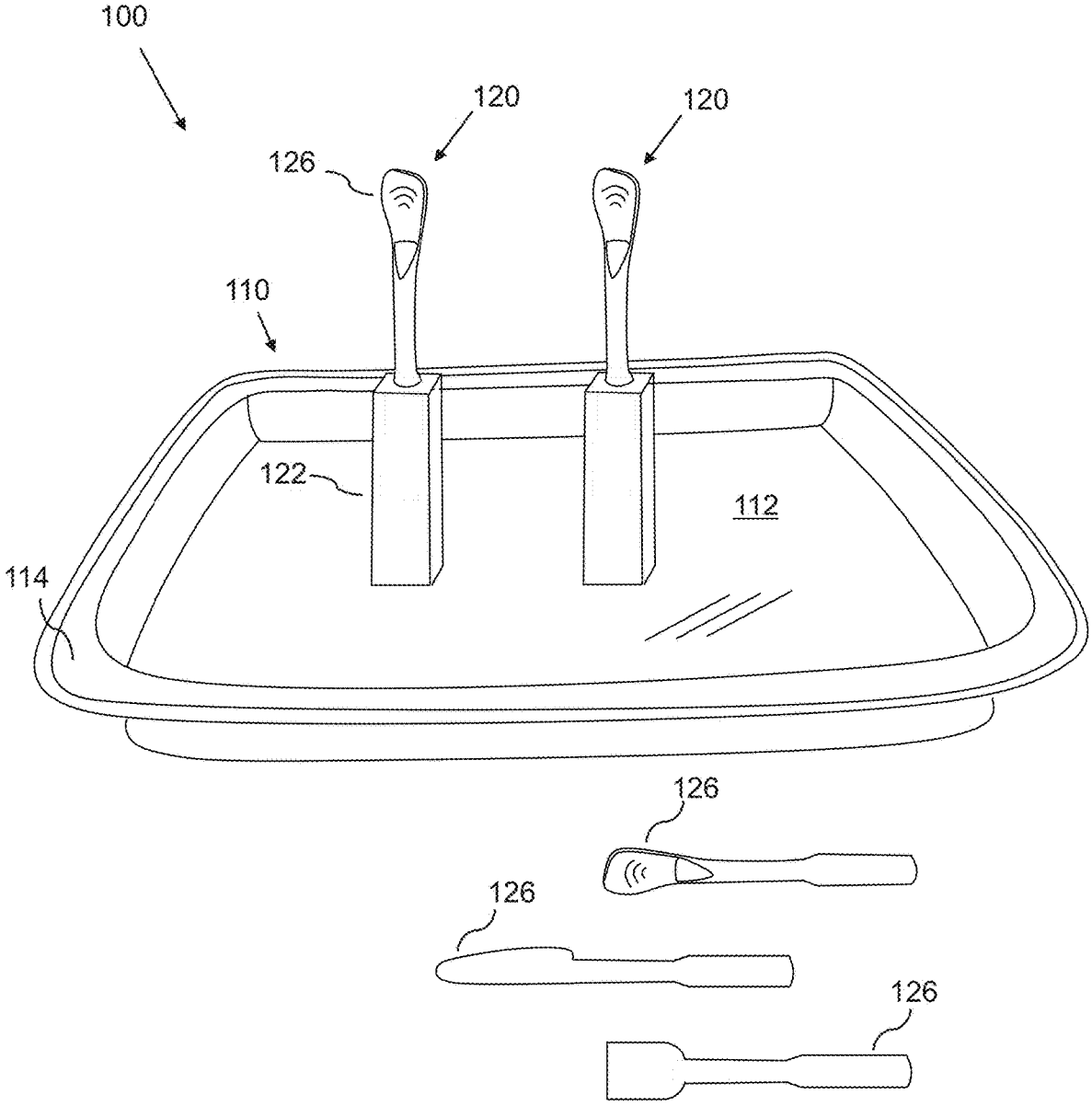
FIG. 1 is a perspective view of a magnetic tool system, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a magnetic tool system 100 with reference to FIG. 1, in such manner that like reference numerals refer to like components throughout; a convention that we shall employ for the remainder of this specification.

Figure 4A:
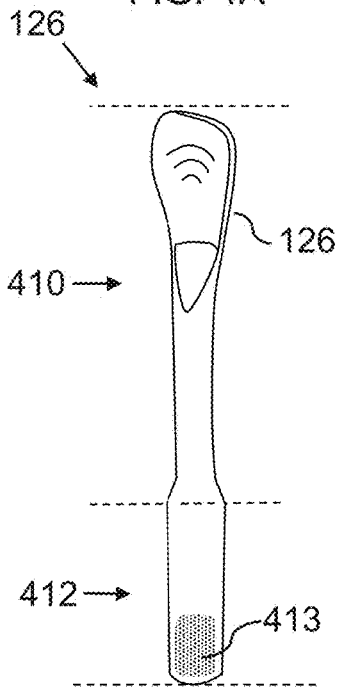
FIG. 4A is a front view of an interchangeable tool portion of a magnetic tool system, according to an embodiment of the invention.
Figure 4B:
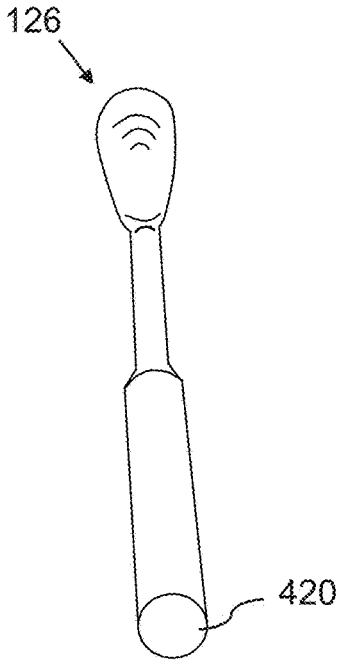
FIG. 4B is a lower perspective view of an interchangeable tool portion of a magnetic tool system, according to an embodiment of the invention.
Figure 4C:
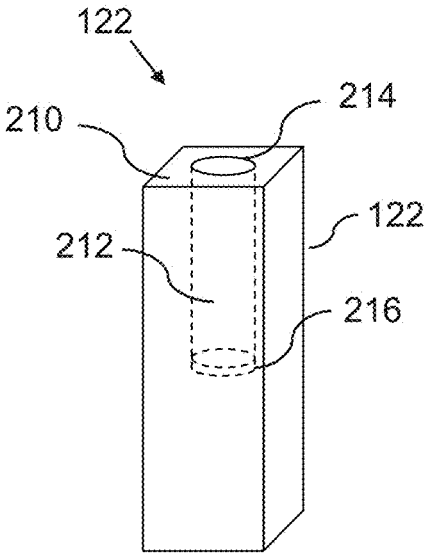
FIG. 4C is a perspective view of a mounting handle of a magnetic tool system, according to an embodiment of the invention.
Figure 4D:
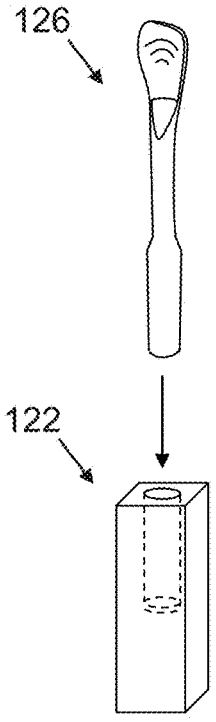
FIG. 4D is a perspective view illustrating the interchangeable tool portion and mounting handle before the assembly of an assembled tool of a magnetic tool system, according to an embodiment of the invention.
Figure 4E:
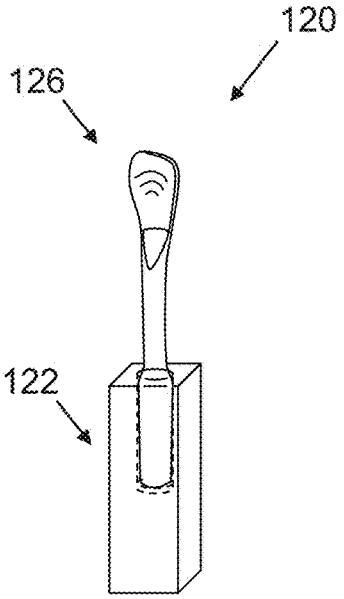
FIG. 4E is a perspective view illustrating the interchangeable tool portion and mounting handle after the assembly of an assembled tool of a magnetic tool system, according to an embodiment of the invention.
Figure 5A:
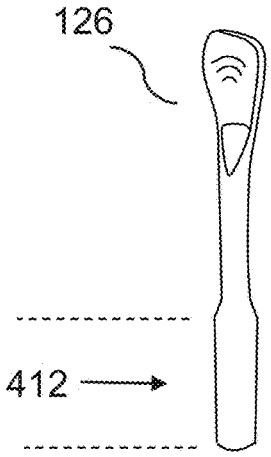
FIG. 5A is front view of an interchangeable tool portion of a magnetic tool system, according to an embodiment of the invention.
Figure 5B:
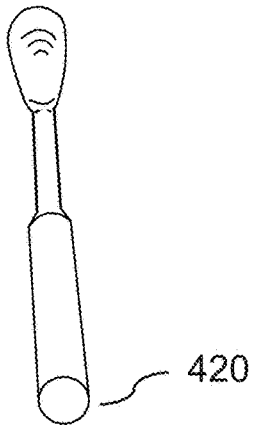
FIG. 5B is lower perspective view of an interchangeable tool portion of a magnetic tool system, according to an embodiment of the invention.
Figure 5C:
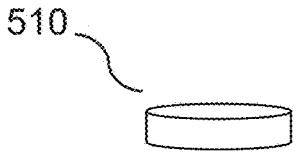
FIG. 5C is a perspective view of a connection magnet of a magnetic tool system, according to an embodiment of the invention.

In an embodiment, as shown in FIGS. 1, 4D, and 4E, a tool system 100 can include:

a) a tool base 110, which includes a substantially flat tool receiving area 112, wherein the tool base can be made from a magnetic metal;

b) at least one mounting handle 122, wherein the at least one mounting handle 122 can be configured to be positionable in an upright position on the tool base 110; and c) at least one interchangeable tool portion 126, which can be configured to be detachably attachable to the at least one mounting handle 122, as shown in FIGS. 4D and 4E;

such that the at least one interchangeable tool portion 126 can be held upright by the at least one mounting handle 122, such that together the at least one interchangeable tool portion 126 and the at least one mounting handle 122 are configured to form an assembled tool 120, when the at least one interchangeable tool portion 126 is attached to the at least one mounting handle 122;

whereby the assembled tool 120 is configured to stand in an upright position on the tool base, with a lower end of the at least one mounting handle 122 positioned on the tool base 110.

In a related embodiment, the tool base 110 can be configured as a tray, which includes an outer rim 114 and a flat inner platform 112, such that the outer rim 114 and inner platform 112 can be made of a magnetic metal.

In another related embodiment, the tool system 100 can include a plurality of mounting handles 122, such that a selected interchangeable tool portion 126 in the plurality of interchangeable tool portions 126 can be inserted into a corresponding mounting handle 122 in the plurality of mounting handles 122, whereby the selected interchangeable tool portion 126 and the corresponding mounting handle 122 form an assembled tool 120.

In an embodiment, as shown in FIGS. 2A, 2B, 2C, 2D, and 4A, the mounting handle 122 can include:

a) a receiving interior 212, which can have an entry aperture 214 positioned on the upper surface 210 of the at least one mounting handle 122, such that the entry aperture 214 provides access to the receiving interior 212 of the mounting handle 122, such that entry aperture 214 and the receiving interior 212 can be configured to match an external shape of a lower portion 412, as seen in FIG. 4A, of the at least one interchangeable tool portion 126, such that the lower portion 412 of the at least one interchangeable tool portion 126 can be inserted into the receiving interior 212 via the entry aperture 214, such that the interchangeable tool portion 126 is detachably attached to the mounting handle 122.

Figure 2A:
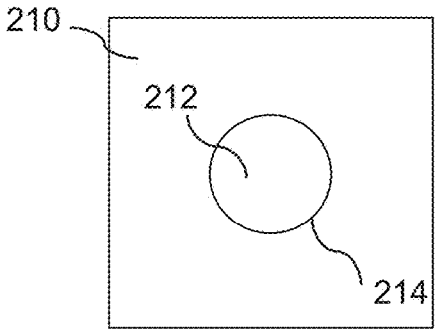
FIG. 2A is a top view of a mounting handle of a magnetic tool system, according to an embodiment of the invention.
Figure 2B:
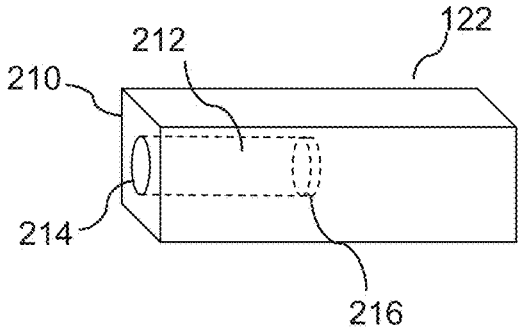
FIG. 2B is a left perspective view of a mounting handle of a magnetic tool system, according to an embodiment of the invention.

In a related embodiment, as shown in FIGS. 2A, 2B and 4A, the receiving interior 212 of the mounting handle 122 can be configured to be an elongated cylinder, such that the receiving interior 212 of the mounting handle 122 is further configured to match an external shape of the lower portion 412, as shown in FIG. 4A, of the at least one interchangeable tool portion 126.

Figure 3A:
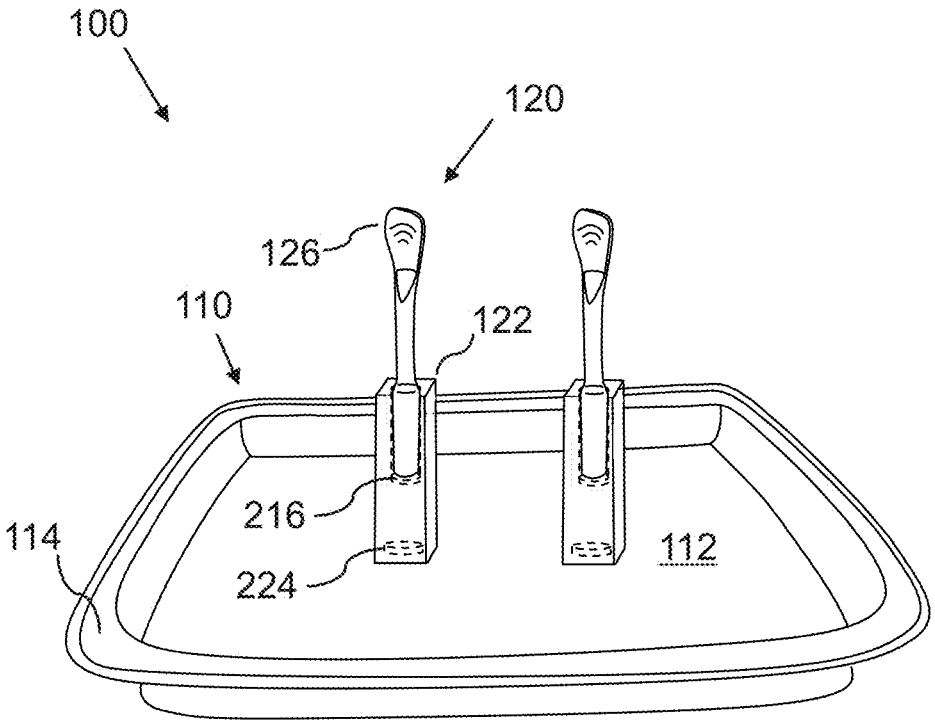
FIG. 3A is a perspective view of a magnetic tool system, according to an embodiment of the invention.
Figure 3B:
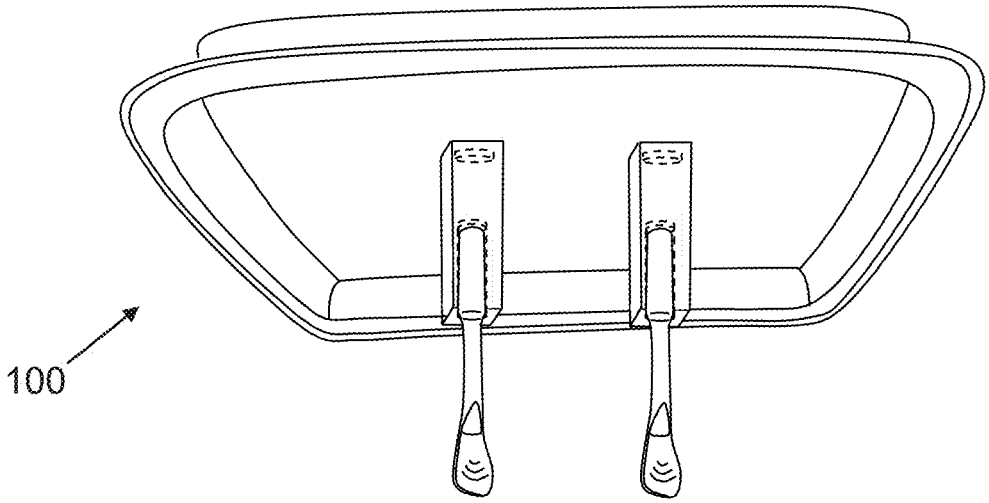
FIG. 3B is a perspective view of a magnetic tool system in an upside-down state, according to an embodiment of the invention.

In another related embodiment, as shown in FIGS. 2B, 2C, 2D, 3A, 3B, and 4A, the mounting handle can include:

a) a lower magnet 224, which can be positioned in a lower end portion of the at least one mounting handle 122, such that the lower magnet 224 can be attracted to the magnetic metal of the tool base 110, such that the at least one mounting handle 122 can be secured in an upright position by the lower magnet 224;

whereby the at least one mounting handle 122 retains its position when the tool base 110 is flipped vertically about a horizontal axis, as shown in FIGS. 3A and 3B; and b) an inner magnet 216, such that the inner magnet 216 is positioned in proximity of the receiving interior 212;

wherein the lower portion 412 of the at least one interchangeable tool portion 126 can include a magnetic portion 413, which is made from a magnetic metal, including pure magnetic metals and magnetic metal alloys;

such that the inner magnet 216 secures the lower portion 412 of the at least one interchangeable tool portion 126, when the lower portion 412 of the at least one interchangeable tool portion 126 is inserted into the mounting handle 122 through the entry aperture 214, such that the interchangeable tool portion 126 can securely retain its position, whereby the interchangeable tool portion 126 remains inside the mounting handle 122 when the mounting handle 122 is flipped vertically about a horizontal axis, as shown in FIGS. 3A and 3B.

In a related embodiment, the inner magnet 216 can be configured to be a solid cylinder, such that the inner magnet 216 can be configured to match the diameter of the receiving interior 212, such that the inner magnet 216 can be positioned in a bottom of the receiving interior 212 and for example affixed with adhesive, as shown in FIG. 2B.

In another related embodiment, the lower portion 412 of the interchangeable tool portion 126 or the entire interchangeable tool portion 126 can be made from a magnetic metal or magnetic metal alloy, such as a magnetic stainless steel.

Figure 2C:
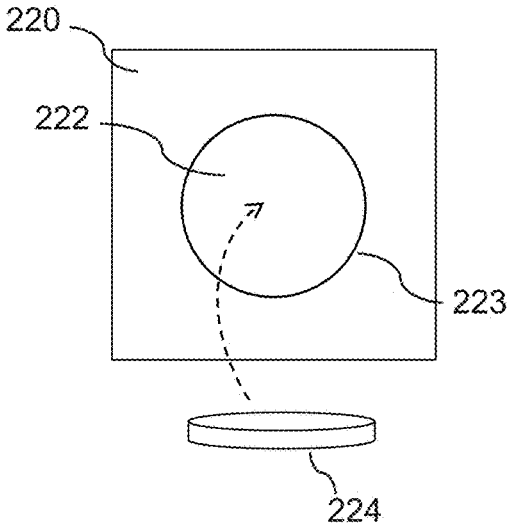
FIG. 2C is a bottom view of a mounting handle of a magnetic tool system, according to an embodiment of the invention.
Figure 2D:
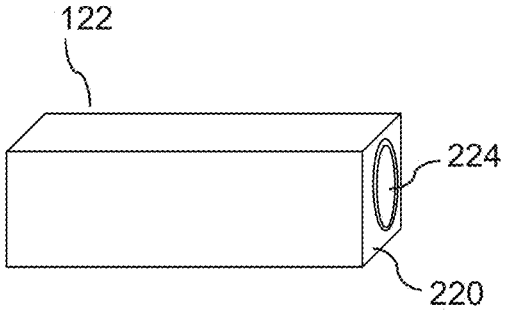
FIG. 2D is a right perspective view of a mounting handle of a magnetic tool system, according to an embodiment of the invention.

In an embodiment, the at least one mounting handle can include:

a) a lower receiving indentation 222, which can be positioned in a bottom surface 220 of the at least one mounting handle;

such that the lower magnet 224 can be configured to be insertable into the lower receiving indentation 222 and for example affixed with adhesive, such that a bottom surface of the lower magnet 224 is flush with the bottom surface 220 of the at least one mounting handle 122, as shown in FIG. 2D;

In a related embodiment, as shown in FIGS. 2C, and 2D, the lower receiving indentation 222 can have an entrance 223 positioned on the lower surface 220, such that the lower receiving indentation 222 can be configured to match a magnet 224, which can be configured to be a thin solid cylinder.

In an embodiment, as shown in FIGS. 4A, 4B, and 4C, an interchangeable tool portion 126 can further include:

a) a tool top 410, such that an elongated cylindrical portion can extend the distance between the upper surface 210 of the mounting handle 122 and the upper end of tool top 410, such that the tool head sits at a length relative to the lower surface 220 of the mounting handle 122 that enables ease of use; and b) a tool body 412, such that an upper end of the tool body 412 is connected to a lower end of the tool top 410;

wherein the tool body 412 comprises the lower portion of the at least one interchangeable tool portion 126.

In a related embodiment, as shown in FIGS. 4A, 4B, and 4C, the tool body 412 can further include:

a) a magnetic lower surface 420, wherein when at least one interchangeable tool portion 126 is inserted into mounting handle 122 through the entry aperture 214 and into the receiving interior 212, the magnetic lower surface 420 can be configured to attract to the inner magnet 216.

Figure 6A:
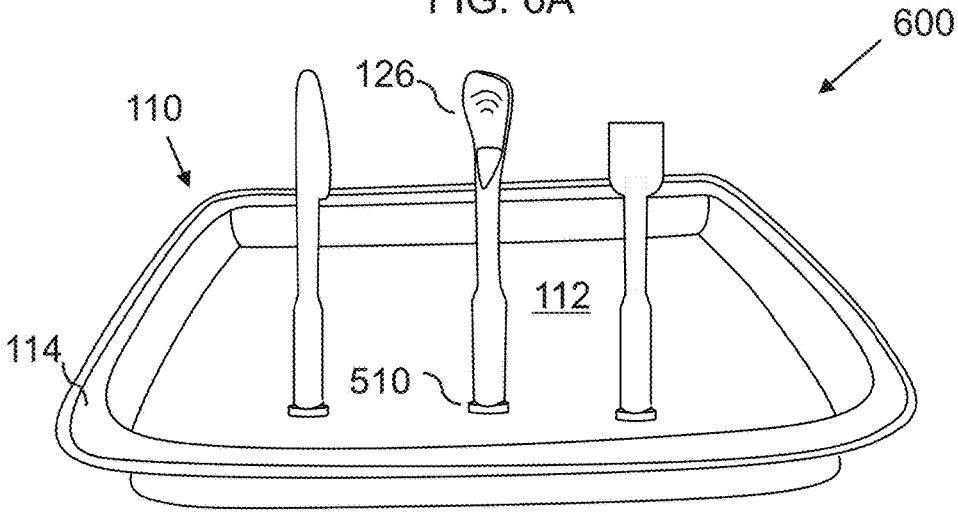
FIG. 6A is a perspective view of a magnetic tool system, according to an embodiment of the invention.
Figure 6B:
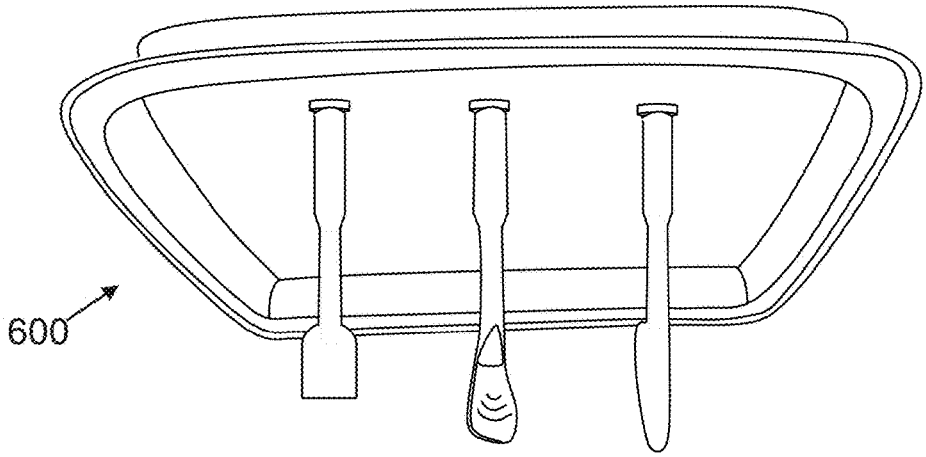
FIG. 6B is a perspective view of a magnetic tool system in an upside-down state, according to an embodiment of the invention.

In a further related embodiment, as shown in FIGS. 5A, 5B, 5C, 6A, and 6B, the tool system 600 can further include:

a) at least one connection magnet 510, which can be positionable on the tool base 110, such that the at least one connection magnet 510 can be secured in position by an attraction to the magnetic metal;

such that the magnetic lower surface 420 of the at least one interchangeable tool portion 126 can be attracted to the at least one connection magnet 510, such that the at least one interchangeable tool portion 126 can be held upright by the at least one connection magnet 510 on the tool base 110;

whereby the at least one connection magnet 510 can be configured to detachably attach the at least one interchangeable tool portion 126 to the tool base 110 in an upright position;

whereby the interchangeable tool portion 126 can retain its position when the metal surface is flipped vertically about a horizontal axis, as shown in FIGS. 6A and 6B.

Figure 7:
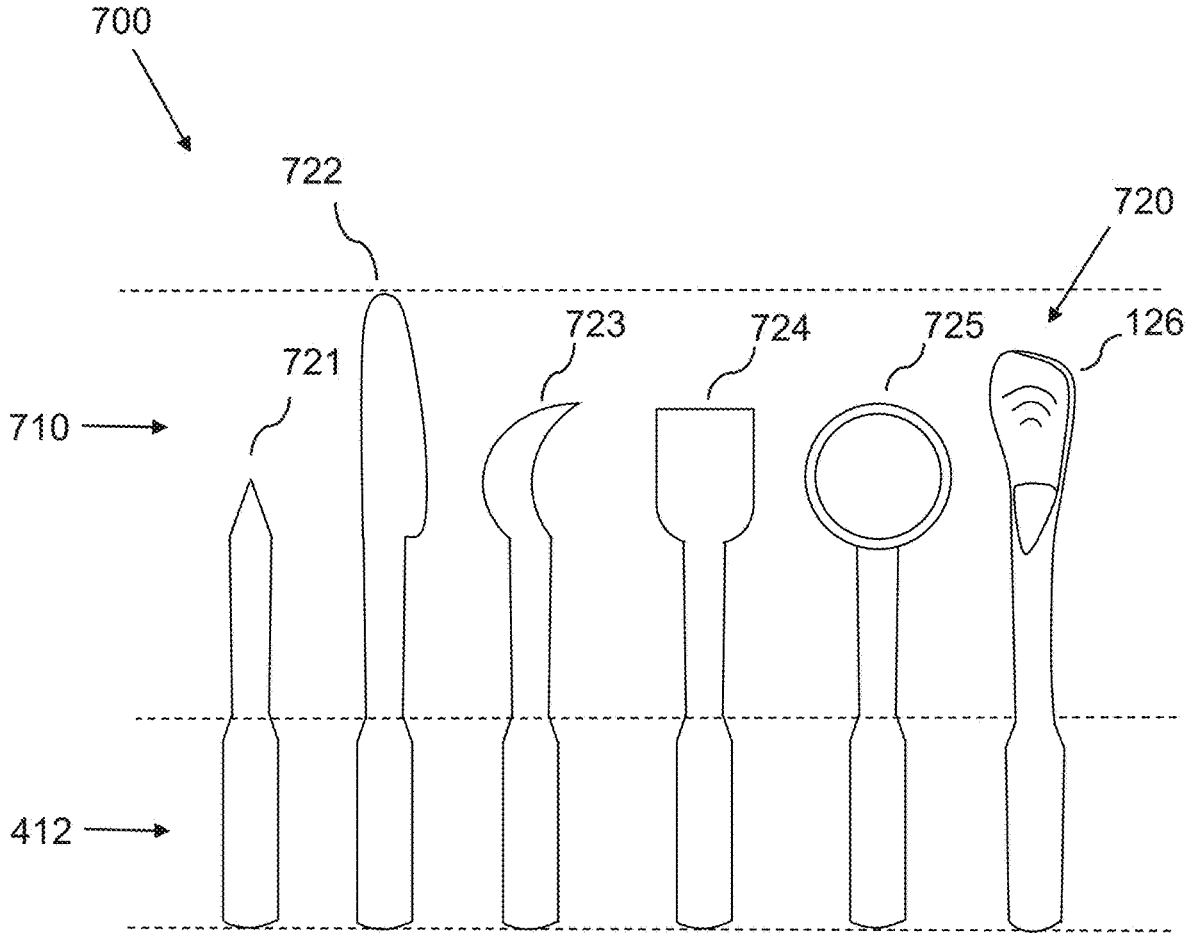
FIG. 7 is a front view of a plurality of interchangeable tool portions of a magnetic tool system, according to an embodiment of the invention.

In an embodiment, as shown in FIG. 7, the tool system 100 can be configured for a particular usage, wherein a plurality of interchangeable tool portions 700 can be configured with tool tops 710 designed for a particular usage, wherein a plurality of interchangeable tool portions 700 can include:

a) A woodworking tool assembly/kit 700, which can include interchangeable tool portions 720 adapted for woodworking, wherein tool tops 710 can include:

i. a first tool top 721, which is configured as a small cone that comes to a sharp point;

ii. a second tool top 722, which is configured as a knife with one flat edge and another sharp curved edge;

iii. a third tool top 723, which is configured as a flat crescent shape that comes to a sharp point;

iv. a fourth tool top 724, which is configured as a rectangle with curved lower edges that form a shovel-like shape;

v. a fifth tool top 725, which is configured as a hemisphere with an open flat surface;

b) A dentistry tool assembly/kit 700, which can include interchangeable tool portions 720 adapted for dental use;

c) A watchmaker tool assembly/kit 700, which can include interchangeable tool portions 720 adapted for watchmaking use;

d) A cannabis extraction tool assembly/kit 700, such that a tool top 410 can be configured for cannabis extraction, wherein the tool top 410 comprises a curved spoon-shaped portion (or spatula-shaped portion), forming a assembled tool 120 commonly referred to as a dabber tool 120 in the cannabis industry, such that the dabber tool 120 can be used to scrape up cannabis paste-like extract and placed unto a water pipe filtration device used for smoking cannabis; and e) Kits 700 adapted for dentistry, watch repair, surgical procedure, etc.

Figure 8:
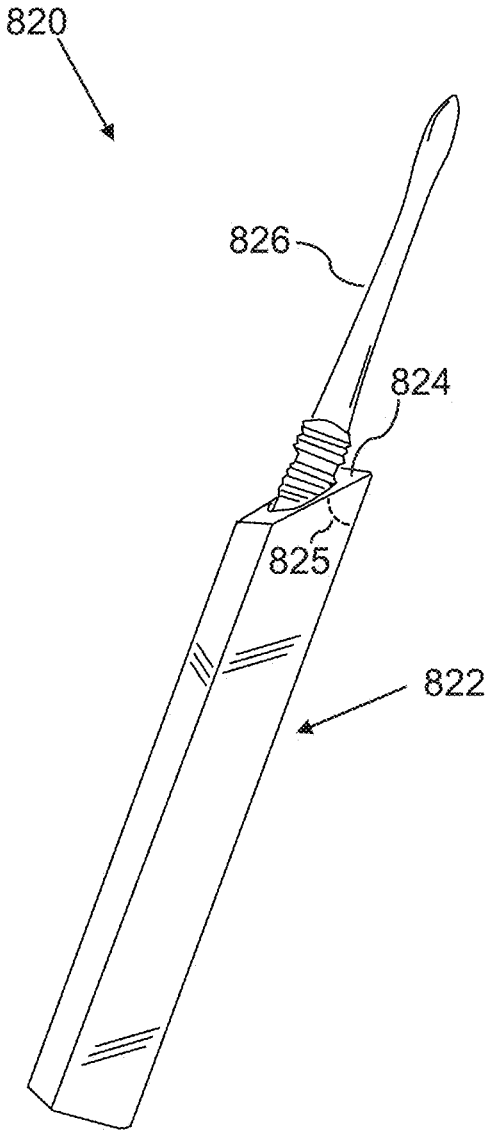
FIG. 8 is a perspective view of an assembled tool of a magnetic tool system, according to an embodiment of the invention.

In a related embodiment, as shown in FIG. 8, a top surface 824 of the mounting handle 822 can be configured with an angled cut, such that a cut angle 825 of the top surface 824 can for example be in a range of 10 to 80 degrees, 20 to 70 degrees, or 30 to 60 degrees. The angled cut may provide a pleasant ornamental design, but can also provide an improved grip and an improved visibility of the interchangeable tool portion 826 and the surrounding environment during use of the assembled tool 820, such as during dabbing.

Here has thus been described a multitude of embodiments of the magnetic tool system device, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent and should be considered fully included in this specification and the claims appended hereto. Accordingly, since numerous modifications and variations will readily occur to those skilled in the art, the invention is not limited to the exact construction and operation illustrated and described, and thus, all suitable modifications and equivalents may be resorted to, falling within the scope of the invention.

What is claimed is:

1. A tool system, comprising:

a) a tool base, comprising a substantially flat tool receiving area, wherein the tool base is made from a magnetic metal and wherein the tool base is configured as a tray, which comprises an outer rim and an inner flat platform;

b) at least one mounting handle, wherein the at least one mounting handle is configured to be positionable in an upright position on the tool base, and wherein the at least one mounting handle comprises:

a lower magnet, positioned in a lower end portion of the at least one mounting handle;

such that the lower magnet is attracted to the magnetic metal of the tool base, when the mounting handle is positioned on the tool base, such that the mounting handle is secured in the upright position by the lower magnet;

c) at least one interchangeable tool portion, which is configured to be detachably attachable to the at least one mounting handle; and d) at least one connection magnet, which is positionable on the tool base, such that the at least one connection magnet is secured in position by an attraction to the magnetic metal;

wherein the at least one interchangeable tool portion comprises a magnetic portion, which is made from a magnetic metal;

such that the magnetic portion is attracted to the at least one connection magnet, such that the at least one interchangeable tool portion is held upright by the at least one connection magnet;

such that the at least one connection magnet is configured to detachably attach the at least one interchangeable tool portion to the tool base in an upright position;

such that the at least one interchangeable tool portion and the at least one mounting handle are configured to form an assembled tool, when the at least one interchangeable tool portion is attached to the at least one mounting handle, wherein the mounting handle is configured to receive no more than one interchangeable tool portion;

such that the assembled tool is configured to stand in an upright position on the tool base, with a lower end of the at least one mounting handle positioned on the tool base.

2. The tool system of claim 1, wherein the at least one mounting handle comprises a plurality of mounting handles, and wherein the at least one interchangeable tool portion comprises a plurality of interchangeable tool portions;

whereby a selected interchangeable tool portion in the plurality of interchangeable tool portions is insertable into a corresponding mounting handle in the plurality of mounting handles, whereby the selected interchangeable tool portion and the corresponding mounting handle form the assembled tool.

3. The tool system of claim 1, wherein the at least one mounting handle comprises:

a receiving interior, which comprises an entry aperture on an upper surface of the at least one mounting handle, such that the entry aperture provides access to the receiving interior, such that a lower portion of the at least one interchangeable tool portion is insertable into the receiving interior via the entry aperture.

4. The tool system of claim 3, wherein the receiving interior is configured as an elongated cylinder.

5. The tool system of claim 1, wherein the at least one mounting handle comprises:

a lower receiving indentation, positioned in a bottom surface of the at least one mounting handle;

such that the lower magnet is configured to be insertable into the lower receiving indentation, such that the lower magnet is positioned in the lower receiving indentation, such that a bottom surface of the lower magnet is flush with the bottom surface of the at least one mounting handle.

6. The tool system of claim 1, wherein the lower magnet is configured to be a solid cylinder.

7. The tool system of claim 3, wherein the at least one mounting handle comprises:

an inner magnet, such that the inner magnet is positioned in proximity of the receiving interior;

wherein the at least one interchangeable tool portion comprises a magnetic portion, which is made from a magnetic metal;

such that the inner magnet secures the magnetic portion when the lower portion of the at least one interchangeable tool portion is inserted into the receiving interior, such that the at least one interchangeable tool portion is securely held in position by the inner magnet.

8. The tool system of claim 7, wherein the inner magnet is positioned in a bottom of the receiving interior.

9. The tool system of claim 7, wherein the inner magnet is configured to be a solid cylinder.

10. The tool system of claim 3, wherein the at least one interchangeable tool portion comprises:

a) a tool top; and b) a tool body, such that an upper end of the tool body is connected to a lower end of the tool top;

wherein the tool body comprises the lower portion of the at least one interchangeable tool portion.

11. The tool system of claim 10, wherein the tool top is configured for cannabis extraction, wherein the tool top comprises a spoon-shaped portion.

12. A tool system, comprising:

a tool base, comprising a substantially flat tool receiving area, wherein the tool base is made from a magnetic metal;

at least one assembled tool, comprising:

a mounting handle, wherein the mounting handle is configured to be positionable in an upright position on a tool base, and wherein the mounting handle comprises:

a lower magnet, positioned in a lower end portion of the mounting handle:

such that the lower magnet is attracted to the magnetic metal of the tool base, when the mounting handle is positioned on the tool base, such that the mounting handle is secured in the upright position by the lower magnet wherein the mounting handle is configured to receive no more than one tool portion; and an interchangeable tool portion, which is detachably attached to the mounting handle; and at least one connection magnet, which is positionable on the tool base, such that the at least one connection magnet is secured in position by an attraction to the magnetic metal;

wherein the interchangeable tool portion comprises a magnetic portion, which is made from a magnetic metal;

such that the magnetic portion is attracted to the at least one connection magnet, such that the interchangeable tool portion is held upright by the at least one connection magnet;

such that the at least one connection magnet is configured to detachably attach the interchangeable tool portion to the tool base in an upright position;

such that the at least one assembled tool is configured to stand in an upright position on the tool base, with a lower end of the mounting handle positioned on the tool base.

13. The tool system of claim 12, wherein the mounting handle comprises:

a receiving interior, which comprises an entry aperture on an upper surface of the mounting handle, such that the entry aperture provides access to the receiving interior, such that a lower portion of the interchangeable tool portion is insertable into the receiving interior via the entry aperture.

14. The tool system of claim 12, wherein the mounting handle comprises:

a lower receiving indentation, positioned in a bottom surface of the mounting handle;

such that the lower magnet is configured to be insertable into the lower receiving indentation, such that the lower magnet is positioned in the lower receiving indentation, such that a bottom surface of the lower magnet is flush with the bottom surface of the mounting handle.

15. The tool system of claim 13, wherein the mounting handle comprises:

an inner magnet, such that the inner magnet is positioned in proximity of the receiving interior;

wherein the interchangeable tool portion comprises a magnetic portion, which is made from a magnetic metal;

such that the inner magnet secures the magnetic portion when the lower portion of the interchangeable tool portion is inserted into the receiving interior, such that the interchangeable tool portion is securely held in position by the inner magnet.

16. The tool system of claim 13, wherein the interchangeable tool portion comprises:

a) a tool top; and b) a tool body, such that an upper end of the tool body is connected to a lower end of the tool top;

wherein the tool body comprises the lower portion of the interchangeable tool portion.

17. The tool system of claim 16, wherein the tool top is configured for cannabis extraction, wherein the tool top comprises a spoon-shaped portion.

18. The tool system of claim 13, wherein a top surface of the mounting handle is configured with an angled cut, such that a cut angle of the top surface is in a range of 30 to 60 degrees.

19. A tool system, comprising:

a) a tool base, comprising a substantially flat tool receiving area, wherein the tool base is made from a magnetic metal;

b) a plurality of mounting handles, wherein each mounting handle is configured to be positionable in an upright position on the tool base, and wherein each mounting handle comprises:

a lower magnet, positioned in a lower end portion of the mounting handle;

such that the lower magnet is attracted to the magnetic metal of the tool base, when the mounting handle is positioned on the tool base, such that the mounting handle is secured in the upright position by the lower magnet;

wherein each mounting handle is configured to receive no more than one interchangeable tool portion;

c) a plurality of interchangeable tool portions, wherein each interchangeable tool portion is configured to be detachably attachable to each mounting handle in the plurality of mounting handles;

such that any selected interchangeable tool portion in the plurality of interchangeable tool portions is insertable into any corresponding mounting handle in the plurality of mounting handles, such that the selected interchangeable tool portion and the corresponding mounting handle are configured to form an assembled tool;

such that the assembled tool is configured to stand in an upright position on the tool base, with a lower end of the corresponding mounting handle positioned on the tool base.

20. The tool system of claim 19, wherein the tool base is configured as a tray, which comprises an outer rim and an inner flat platform.

21. The tool system of claim 19, wherein the at least one mounting handle comprises:

a lower magnet, positioned in a lower end portion of the at least one mounting handle;

such that the lower magnet is attracted to the magnetic metal of the tool base, when the mounting handle is positioned on the tool base, such that the mounting handle is secured in the upright position by the lower magnet.

22. The tool system of claim 19, wherein each mounting handle comprises:

a receiving interior, which comprises an entry aperture on an upper surface of the mounting handle, such that the entry aperture provides access to the receiving interior, such that a lower portion of the interchangeable tool portion is insertable into the receiving interior via the entry aperture; and an inner magnet, such that the inner magnet is positioned in proximity of the receiving interior;

wherein each interchangeable tool portion comprises a magnetic portion, which is made from a magnetic metal;

such that the inner magnet secures the magnetic portion when the lower portion of the interchangeable tool portion is inserted into the receiving interior, such that the interchangeable tool portion is securely held in position by the inner magnet.

23. The tool system of claim 22, wherein the inner magnet is positioned in a bottom of the receiving interior.

24. The tool system of claim 19, wherein each interchangeable tool portion comprises:

a) a receiving interior, which comprises an entry aperture on an upper surface of the corresponding mounting handle, such that the entry aperture provides access to the receiving interior;

b) a tool top; and c) a tool body, such that an upper end of the tool body is connected to a lower end of the tool top, such that the tool body is configured to be insertable into the receiving interior via the entry aperture.

25. The tool system of claim 19, further comprising:

at least one connection magnet, which is positionable on the tool base, such that the at least one connection magnet is secured in position by an attraction to the magnetic metal;

wherein each interchangeable tool portion comprises a magnetic portion, which is made from a magnetic metal;

such that the magnetic portion is attracted to the at least one connection magnet, such that each interchangeable tool portion is configured to be held upright by the at least one connection magnet;

such that the at least one connection magnet is configured to detachably attach the selected interchangeable tool portion to the tool base in an upright position.

* * * * *